US006050452A

United States Patent [19]

Pradinas

[11] Patent Number: 6,050,452

[45] Date of Patent: Apr. 18, 2000

[54] PUSH-PULL CLOSURE WITH REINFORCED TAMPER-PROOFING

[75] Inventor: Claude Pradinas, Couzou au Mont d'Or, France

[73] Assignee: Novembal, Paris, France

[21] Appl. No.: 08/966,036

[22] Filed: Nov. 7, 1997

[30] Foreign Application Priority Data

Sep. 10, 1997 [FR] France ..... 97 11240

[51] Int. Cl.[7] ..... B67B 5/00

[52] U.S. Cl. ..... 222/153.02; 222/153.06; 222/153.07; 222/525

[58] Field of Search ..... 222/153.06, 153.07, 222/153.02, 153.1, 153.14, 521–525, 562; 215/252, 277, 311, 318

[56] References Cited

U.S. PATENT DOCUMENTS

| | | | |
|---|---|---|---|
| 5,104,008 | 4/1992 | Crisci | 222/525 |
| 5,328,063 | 7/1994 | Beck et al. | 222/524 |
| 5,456,374 | 10/1995 | Beck | 222/524 |
| 5,507,416 | 4/1996 | Rapchak et al. | 222/153.07 |
| 5,810,185 | 9/1998 | Groesbeck | 222/525 |

*Primary Examiner*—Andres Kashnikow
*Assistant Examiner*—Dinh Q. Nguyen
*Attorney, Agent, or Firm*—Young & Thompson

[57] ABSTRACT

A push-pull type closure includes a collar with an internal thread, a button associated with the collar, and a cap covering the button before the closure is first open, the cap including a tamper-proofing strip which is non-releasably confined in a groove of the collar, the transverse section of the tamper-proofing strip having a profile in the shape of a U which is open at the top, and the annular strip including an extreme portion which becomes lodged in the hollow of the U during crimping.

23 Claims, 2 Drawing Sheets

PUSH-PULL CLOSURE WITH REINFORCED TAMPER-PROOFING

The invention relates to the technical field of push-pull type closures which allow direct drinking from the neck of the bottle.

BACKGROUND OF THE INVENTION

Such closures are conventionally composed of a collar and a mouthpiece.

The opening is opened, for example by pulling on the mouthpiece with the teeth.

Pushing on the mouthpiece closes it.

Closures of the above type which are known in the prior art are generally not provided with tamper-proofing means other than a retractable sleeve.

OBJECT AND SUMMARY OF THE INVENTION

The object of the invention is to provide a closure system of the type described above, comprising reinforced tamper-proofing means and an indicator of first opening.

The invention thus provides a push-pull type closure comprising:

a collar provided with an internal thread;

a button associated with the collar and movable with respect to said collar between a closed position and an open position; and a cap covering the button before the closure is opened for the first time;

wherein the cap includes at its base a tamper-proofing strip connected to the cap by frangible bridges, said tamper-proofing strip being non releasably confined in a groove in the collar.

BRIEF DESCRIPTION OF THE DRAWINGS

Further objects and advantages of the invention become more clear from the following description of an embodiment, made with reference to the accompanying drawings, in which.

MORE DETAILED DESCRIPTION

Figure 1:
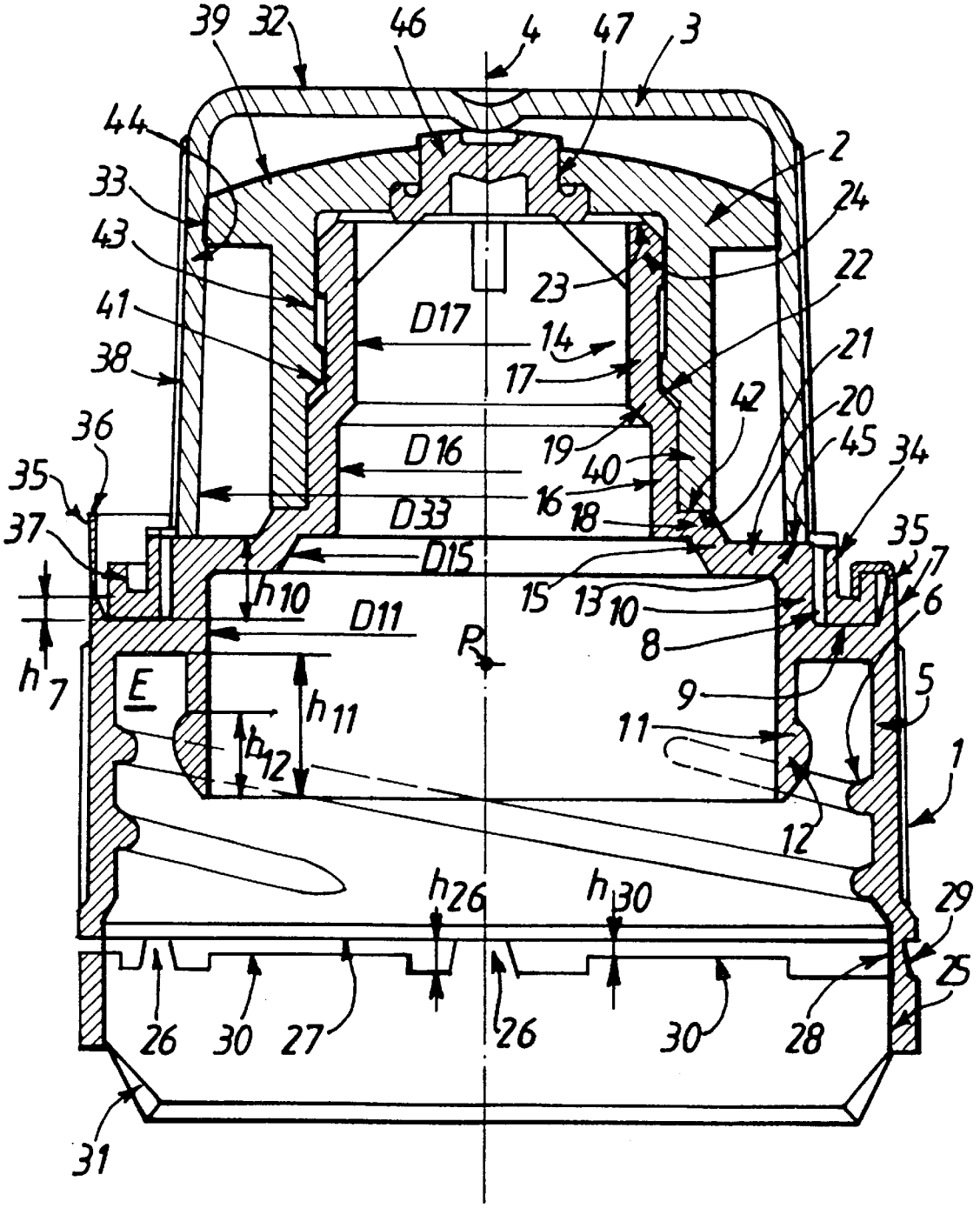
FIG. 1 is a longitudinal cross section through a closure system of the invention.
Figure 2:
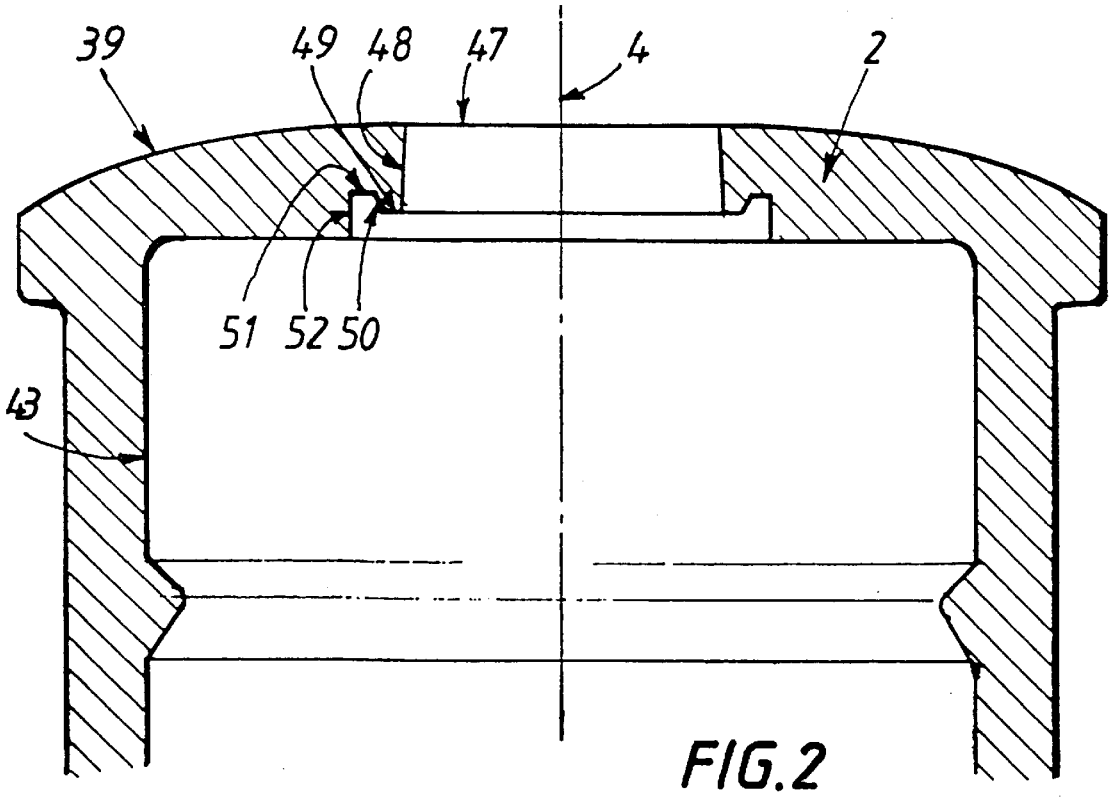
FIGS. 2 and 3 are detailed views of closure systems of the invention.
Figure 3:
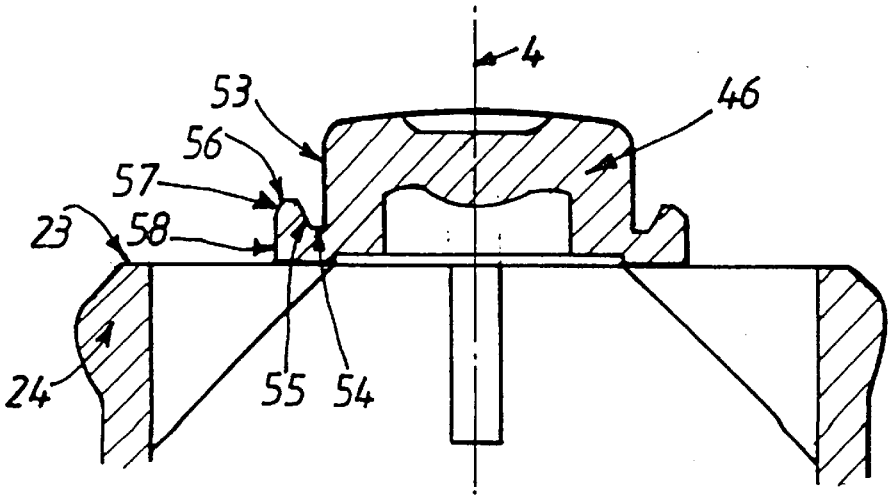

In the following text and unless otherwise stated, the terms "upper", "lower", "top", "external" are used relative to a point P located at the center of the closure system.

The closure system shown comprises three parts.

These are a collar 1, a mouthpiece or button 2 and a cap 3.

The assembly in the embodiment shown is a body of revolution about an axis 4.

Collar 1 is described first.

Collar 1 comprises an external lateral skirt 5 provided with an internal thread 6.

The upper portion of external lateral skirt 5 defines an external annular projection 7 which is substantially vertical.

The projection 7 forms the outer limit of an annular groove 8.

The base of groove 8 is formed by a substantially horizontal annular wall 9 which is perpendicular to external lateral skirt 5.

A substantially vertical wall 10 which is concentric with external lateral skirt 5 forms the inner limit of groove 8.

Wall 10 extends upwards over a height hlo which is greater than the height $h_7$ of projection 7, measured from the base of groove 8.

Wall 10 extends downwardly below the surface formed by wall 9 to form an internal lateral skirt 11 which is concentric with the external lateral skirt 5.

The extreme lower portion of internal lateral skirt 11 comprises an external lateral bead 12 which forms a sealing lip.

In the embodiment shown, bead 12 extends over a height $h_{12}$ which is of the order of half the vertical dimension $h_{11}$ of internal lateral skirt 5–11.

The external and internal lateral skirts 5 and 11 define, over a height $h_{11}$, an annular space E which is limited at the top by wall 9 of groove 8, and which is open at the bottom.

The substantially horizontal upper surface 13 of wall 10 forms a bearing surface for the lower rim of the skirt of cap 3.

From bottom to top, the upper portion 14 of collar 1 comprises three zones 15, 16, 17 of decreasing diameters, separated by shoulders 18, 19.

The first zone 15, which is substantially in the form of a truncated cone, is delimited at the bottom by a substantially horizontal annular wall 20.

Wall 20 is substantially perpendicular to wall 10.

Thus diameter $D_{15}$ at the base of truncated cone portion 15 is smaller than internal diameter $D_{11}$ of skirt 11.

The first zone 15 has a diameter which decreases from bottom to top of the closure system.

A shoulder 18 separates the first zone 15 from the substantially cylindrical zone 16 of collar 1.

Shoulder 18 defines an outer annular bearing surface 21 for the end surface of button or mouthpiece 2.

The second zone 16, which is substantially cylindrical about axis 4, has an internal diameter $D_{16}$ which is smaller than the minimum diameter of truncated cone portion 15.

A shoulder 19 separates the second cylindrical zone 16 from the third, end, zone 17 of collar 1.

Shoulder 19 defines an outer annular surface 22 in the form of a truncated cone, which abuts a complementary surface of button 2 in the closed position of the closure.

The third zone 17, which is substantially cylindrical about axis 4, has an internal diameter $D_{17}$ which is smaller than the internal diameter $D_{16}$ of second zone 16.

The third, end, zone 17 has an external lateral sealing bead 24 close to its open rim 23.

The external lateral skirt 5 of collar 1 is extended at its lower portion by a tamper-proofing strip 25.

The tamper-proofing strip 25 is connected to the lower rim 27 of skirt 5 by means of frangible bridges 26.

The upper portions of frangible bridges 26 have a smaller cross section than the lower portions.

In the embodiment shown, these frangible bridges 26 have are of substantially triangular cross section.

Bridges 26 are delimited on the inside by a substantially vertical surface 28 and on the outside by a surface 29 which is inclined to the vertical.

The shape of these bridges 26 encourages preferential rupture close to the zone of their attachment to tamper-proofing strip 25 when opened for the first time.

Bearing surfaces 30 separate frangible bridges 26 from each other.

These bearing surfaces 30 form crenellations.

The distance $h_{30}$ between the lower rim 27 of skirt 5 and bearing surface 30 is less than the height $h_{26}$ of frangible bridges 26.

Thus when the closure is placed on the neck of the receptacle (not shown), bearing zones 30 abut against lower rim 27 of skirt 5.

Premature rupture of frangible bridges 26 is thus avoided.

An annular lip 31 extends below tamper-proofing strip 25.

Lip 31 is intended to be returned inwardly in known fashion when the closure is fitted to the neck of the receptacle.

Collar 1 can be formed from a plastics material such as polypropylene or polyethylene.

Cap 3 is now described.

Cap 3 comprises a body formed from a transverse end wall 32 and a lateral skirt 33, which is slightly tapered, flaring downwards.

The maximum internal diameter $D_{33}$ defined by skirt 33 is slightly larger than the internal diameter $D_{11}$ defined by the internal lateral skirt 11 of collar 1.

The bottom of cap 3 comprises a tamper-proofing strip 34 connected to cap 3 by means of frangible or tearable bridges.

The frangible bridges extend substantially horizontally and their cross section tapers inwards to facilitate rupture close to the lower rim of the cap.

This tamper-proofing strip for cap 3 is trapped in collar 1, for example as follows.

As shown, external lateral skirt 5 comprises an annular strip 35 which extends projection 7.

Strip 35 can be irreversibly crimped, using heat or any other means, onto tamper-proofing strip 34 of the cap, which is thus held in groove 8 of collar 1.

On the left hand side of the accompanying figure, strip 35 is shown in its uncrimped state, while the right hand side of the figure shows strip 35 crimped and trapping tamper-proofing strip 34 of cap 3.

In cross or radial section, tamper-proofing strip 34 is in the form of a U which is open at the top.

During crimping, the end portion 36 of strip 35 becomes lodged in the hollow of the U of tamper-proofing strip 34 of cap 3.

More precisely, this end portion 36 is pressed against the internal surface of the external annular wall 37 of tamper-proofing strip 34.

In one embodiment, cap 3 includes external serrations or fluting 38 to aid gripping.

In a further embodiment, at least part of the external surface of cap 3 is roughened.

Mouthpiece 2 is now described.

Mouthpiece 2 comprises a rounded end wall 39, the lower portion of which is extended by an annular wall 40.

The shape of the internal surface of wall 40 substantially corresponds to the external surface of zones 16 and 17 of collar 1.

In particular, a shoulder 41 inside wall 40 abuts against the surface 22 of shoulder 19 of collar 1 when the button or mouthpiece 2 is in its closed position.

Similarly, the lower rim 42 of wall 40 abuts against the surface 21 of shoulder 18 of collar 1 when button 2 is in its closed position.

Similarly again, the upper part of internal surface 43 of wall 40 is in contact with the external bead 24 of the end zone 17 of collar 1.

Mouthpiece 2 is thus mounted on the upper portion of collar 1 to seal it when in the closed or pushed position and to allow flow in the pulled or open position.

In order to ensure that cap 3 is held on re-closing, internal clips 44 in cap 3 coincide with the end wall 39 of mouthpiece 2.

Sealing with the neck of the bottle (not shown) is primarily guaranteed by lip 12 acting like a cone insert.

In order to reinforce cap 3 while it is being installed on the production line, notches can be present in base 45 of cap 3 which coincide with other notches in the surface 13 of collar 1 on which skirt 33 of cap 3 bears.

These notches prevent rotation of cap 3 with respect to collar 1 while the closure is being tightened on the production line.

These notches do not impede rotation of cap 3 when opening, for example in the anticlockwise direction, but block rotation in the tightening direction, for example clockwise.

Cap 3 can be formed from translucent or semi-transparent material to allow the color of the button to be seen.

For example, the color can be linked to the contents of the receptacle to which the closure system is applied.

Opening cap 3 for the first time by rotating it with respect to the receptacle and collar 1 causes rupture of the frangible bridges connecting tamper-proofing strip 34 of cap 3 to skirt 33 of cap 3.

A series of ribs formed on the collar and on the cap prevent mutual rotation of these two parts.

The seal with the neck of the receptacle is preserved when unscrewing the closure until bridges 26 connecting tamper-proofing strip 25 to the external lateral skirt 5 are ruptured.

The seal of the closure is strengthened by nipple 46 of collar 1, the external lateral surface of which defines chicanes with the wall of the corresponding hole 47 in button 2.

More precisely, in the embodiment shown, hole 47 comprises, from its top to its lower rim:

- a substantially vertical annular wall 48;
- a first substantially horizontal annular wall 49;
- a tapered annular wall 50 inclined at an angle which is in the range 10° to 20° to the vertical;
- a second substantially horizontal annular wall 51;
- a substantially vertical annular wall 52.

The second substantially horizontal wall 51 is located in a plane which is above the plane comprising the first substantially horizontal wall 49.

Nipple 46 has, from its top to bottom rim:

- a substantially vertical lateral surface 53;
- a first substantially horizontal lateral surface 54;
- a tapered annular surface 55 inclined at an angle which is in the range 10° to 20° to the vertical;
- a second substantially horizontal lateral surface 56.
- a connecting surface 57 and a substantially vertical surface 58.

When button 2 is in its closed position, the second annular wall 51 of hole 47 bears against the second substantially horizontal surface 56 of nipple 46.

Similarly, the tapered annular wall 50 of hole 47 bears against the tapered surface 55 of nipple 46 and the first substantially horizontal wall 49 of hole 47 bears against the first substantially horizontal surface 54 of nipple 46.

The entire extent of substantially vertical lateral surfaces 53 and 58 of nipple 46 are substantially in contact with the substantially vertical annular walls 48, 52 of hole 47.

Bridges 26 connecting tamper-proofing strip 25 to lateral skirt 5 can be ruptured when, for example, the user wishes to refill the receptacle.

The closure system thus has tamper-proofing at two levels.

A first tamper-proofing level concerns opening the cap for the first time.

A second tamper-proofing level concerns screwing collar 1 off the neck of the receptacle for the first time.

I claim:

1. A push-pull type closure comprising:

a collar provided with an internal thread;

a button associated with the collar and movable with respect to said collar between a closed position and an open position; and a cap covering the button before the closure is opened for the first time;

the cap including at its base a tamper-proofing strip connected to the cap by frangible bridges, said tamper-proofing strip being non-releasably confined in a groove of the collar;

the transverse section of the tamper-proofing strip having a profile which is in the shape of a U which is open at the top; and the annular strip comprising an extreme portion which becomes lodged in the hollow of the U formed by the tamper-proofing strip of the cap during crimping.

2. A closure according to claim 1, wherein the collar comprises an external lateral skirt supporting an internal thread, the external lateral skirt being extended by an external annular projection forming the outer limit of the annular groove for receiving the tamper-proofing strip of the cap.

3. A closure according to claim 2, wherein the collar comprises an annular strip extending the external annular projection, said annular strip trapping the tamper-proofing strip of cap in the groove after crimping.

4. A closure according to one of claim 2, wherein the collar comprises an internal wall extending upwardly to a height $h_{10}$ which is greater than the height $h_7$ from the base of the groove, said internal wall extending downwards to form an internal lateral skirt which is concentric with the external lateral skirt.

5. A closure according to claim 4, wherein the internal lateral skirt comprises, at its lower extreme portion, an external lateral bead forming a sealing lip.

6. A closure according to claim 1, wherein the extreme portion of the annular strip is pressed against the external surface of the external annular wall of tamper-proofing strip during crimping.

7. A closure according to claim 1, wherein the upper portion of collar comprises, from bottom to top, three zones of decreasing diameter, separated by first and second shoulders.

8. A closure according to claim 7, wherein the first shoulder separates a first zone in the form of a truncated cone from a second substantially cylindrical zone of collar, said shoulder defining an external annular bearing surface for the lower surface of the button in the closed position of the button.

9. A closure according to claim 7, wherein the second shoulder separates the second substantially cylindrical zone from the third substantially cylindrical zone of collar, the second shoulder defining an external annular surface which is in the form of a truncated cone which abuts against a complementary surface of the button in the closed position of the button.

10. A closure according to claim 7, wherein the third zone of collar has an external lateral sealing bead close to its free rim.

11. A closure according to claim 1, wherein the external lateral skirt of the collar is extended at its lower portion by a tamper-proofing strip connected by means of frangible bridges at the lower rim of the skirt.

12. A closure according to claim 11, wherein the frangible bridges are separated from each other by bearing zones which abut against the lower rim of the external lateral skirt when the closure is placed on the neck of a receptacle.

13. A closure according to claim 1, wherein the mouthpiece or button comprises a rounded end wall extended at its lower portion by an annular wall the internal surface of which has a shape which substantially corresponds with the external surface of zones of the upper portion of the collar.

14. A closure according to claim 13, wherein the wall of the button comprises an internal shoulder which abuts against the surface of shoulder of collar when the button is in its closed position.

15. A closure according to claim 13, wherein the lower rim of the wall of button bears against the surface of shoulder of collar, when the button is in the closed position.

16. A closure according to claim 13, wherein the upper part of the internal surface of the wall is in contact with the bead of the end zone of the collar.

17. A closure according to claims 1, wherein clips or equivalent means inside the cap coincide with the end wall of mouthpiece to ensure that the cap is held in place on re-closing.

18. A closure according to claim 1, wherein notches are formed in the base of cap to coincide with other notches formed in the surface of the collar on which the skirt of the cap bears, the cap thus being reinforced while it is being installed on the production line, said notches not impeding rotation of the cap in the opening direction but blocking such rotation in the closing direction.

19. A closure according to claim 1, wherein the cap comprises a nipple sliding in a hole of the button, the external lateral surface of the nipple defining chicanes with the wall of the hole.

20. A closure according to claim 1, wherein the cap is formed from a translucent or semi-transparent material to allow the color of the button to be seen.

21. A closure according to claim 1, formed from a material selected from the group comprising high or low density polyethylene, polypropylene, their mixtures and their homo- and copolymers.

22. A push-pull type closure comprising:

a collar provided with an internal thread;

a button associated with the collar and movable with respect to said collar between a closed position and an open position; and a cap covering the button before the closure is opened for the first time;

wherein the cap includes at its base a tamper-proofing strip connected to the cap by frangible bridges, said tamper-proofing strip being non-releasably confined in a groove of the collar, and wherein clips or equivalent means inside the cap coincide with the end wall of the mouthpiece to ensure that the cap is held in place on re-closing.

23. A push-pull type closure comprising:

a collar provided with an internal thread;

a button associated with the collar and movable with respect to said collar between a closed position and an open position; and a cap covering the button before the closure is opened for the first time;

wherein the cap includes at its base a tamper-proofing strip connected to the cap by frangible bridges, said tamper-proofing strip being non-releasably confined in a groove of the collar, and wherein notches are formed in the base of the cap to coincide with other notches formed in the surface of the collar on which the skirt of the cap bears, the cap thus being reinforced while it is being installed on the production line, said notches not impeding rotation of the cap in the opening direction but blocking such rotation in the closing direction.

* * * * *